United States Patent [19]

Porteous

[11] 4,131,535

[45] Dec. 26, 1978

[54] TREATMENT OF TUMBLER REJECT

[75] Inventor: Kenneth Porteous, Edmonton, Canada

[73] Assignees: Her Majesty the Queen in right of Canada, as represented by the Minister of Energy, Mines and Resources, Ottawa, Canada; Her Majesty the Queen in right of the Province of Alberta, Government of the Province of Alberta, Department of Energy and Natural Resources, Alberta Syncrude Equity, Edmonton, Canada; Ontario Energy Corporation, Toronto, Canada; Imperial Oil Limited, Toronto, Canada; Canada-Cities Service, Ltd., Calgary, Canada; Gulf Oil Canada Limited, Toronto, Canada

[21] Appl. No.: 768,358

[22] Filed: Feb. 14, 1977

[51] Int. Cl.[2] ..... C10G 1/04

[52] U.S. Cl. ..... 208/11 LE

[58] Field of Search ..... 208/11 LE

[56] References Cited

U.S. PATENT DOCUMENTS

| | | | |
|---|---|---|---|
| 3,068,167 | 12/1962 | White | 208/11 LE |
| 3,619,406 | 11/1971 | Bowman et al. | 208/11 LE |

*Primary Examiner*—Herbert Levine
*Attorney, Agent, or Firm*—E. P. Johnson

[57] ABSTRACT

In the hot water process wherein tar sand is slurried in a tumbler with hot water and sodium hydroxide, oversized material, rejected from the tumbler, is mixed with a portion of slurry flood water in a second slurrying device and subjected therein to heating and dispersal of bitumen associated with the rejects. A bitumen-containing slurry is produced from the second device and this slurry is combined with the tumbler slurry and subsequently subjected to flotation to recover bitumen.

1 Claim, 2 Drawing Figures

TREATMENT OF TUMBLER REJECT

BACKGROUND OF THE INVENTION

The invention finds application in the recovery of bitumen from bituminous sands in the process generally known as the hot water process. More particularly, the invention describes a process for obtaining bitumen from oversized material rejected from the conditioning vessel in which bituminous sand is slurried with hot water in said process.

A large proportion of the world's known hydrocarbon reserves exists in the form of bituminous sand, commonly referred to in the industry as tar sand and hence so referred to hereinafter. One large deposit of this material is found in Alberta, Canada, in an area traversed by the Athabasca River. The tar sand is believed to exist in the form of water-wet grains of sand sheathed in films of bitumen. The bitumen is a valuable hydrocarbon material because, by suitable methods of upgrading and refining, it can be converted to refined liquid and gaseous products useful for domestic and industrial purposes.

The sand particles in the deposit are generally of such a size as to be retained by a screen of 325 mesh, although clays and slits having much smaller particle size are also present. The quantity of bitumen as a proportion of the total composition is typically of the order of 12% by weight.

Many methods have been proposed for recovering the hydrocarbons from tar sand. These include removing the hydrocarbons from mined tar sand by solvent extraction, or by separation with hot water, or by direct thermal treatment. Still other methods, the so-called in situ methods, dispense with the mining step and render the hydrocarbons recoverable by treating the tar sand (usually with heat) in place.

Tar sand presents considerable difficulties in the recovery of the bitumen partly of the very fine nature of some of the mineral solids and partly because of the intimate admixture of the mineral solids and the bitumen. At present the only commercially viable method is the hot water process. The aim of this process is to separate the bitumen from tar sand and in such a form as to allow further purification to remove substantially all associated water and mineral solids. According to the hot water process, mined tar sand is fed to a rotating conditioning vessel, ususally known as the "tumbler", where it is treated with hot water. The water is commonly heated by steam, added directly to the tumbler. Sodium hydroxide is also added in such quantities as to raise the pH of the mixture to about 9.0. Feed materials are fed to the tumbler in the following typical proportions by weight: tar sand, 3250; water 610.3; sodium hydroxide solution (at a specific gravity of 1.22) 4.06.

On emerging from the tumbler, the conditioned slurry is screened and diluted with hot flood water to the extent that the composition of the diluted slurry is typically 7.30% butumen, 42.52% water and 50.18% mineral solids. This mixture is then subjected to bitumen separation. This involves treating it in a flotation vessel, so designed as to allow the bitumen to rise as a froth typically containing 66.4% bitumen, 8.9% mineral solids, and 24.7% water. A further yield of bitumen is obtained from the middlings phase of the flotation vessel and, after combination, the combined froths are treated with a diluent hydrocarbon and advanced to centrifuges to produce purified hydrocarbon mixture which, in turn, may be distilled to remove the diluent so that the resulting free bitumen may then be converted to hydrocarbons of lower molecular weight, collectively known as synthetic crude oil, by thermal treatment.

The slurrying step performed in the tumbler dislodges the bitumen from the tar sand. The slurrying time and mixing intensity can be altered according to the type of tar sand feed being introduced to the tumbler. However the conditions to which the tar sand is subjected affect not only the degree of tar sand digestion, but also the ease with which the bitumen may be isolated from the mixtures in the subsequent separatory steps. Too vigorous treatment or too extended a residence time leads to over-conditioning, which interferes with and reduces the recovery of bitumen in the separatory steps. To avoid over-conditioning, the tumbler must be operated in such a way that some of the harder, more resistant lumps of tar sand are allowed to pass through the tumbler substantially unaffected by the hot water treatment and, on being rejected by the exit screens mentioned above, are removed from the process, thus representing loss of bitumen product. In addition the exit screens also reject oversized rocks and other debris and, as these are coated with a layer of bitumen-containing material, their rejection also contributes to loss of bitumen from the process.

Typically the bitumen content of the rejects is 2.00% by weight and represents about 0.5% of the bitumen in the tar sand feed.

SUMMARY OF THE INVENTION

Hitherto the prior art has made no provision for recovering bitumen rejected from the circuit with the oversized rejects. The present invention is of benefit in the hot water process partly because it allows for recovery of bitumen from tumbler rejects and partly because it achieves this without introducing more water to the process.

According to the invention, oversized tumbler rejects removed by the exit screens, instead of being discarded from the process, are mixed with a portion of the flood water, heretofore added to the tumbler slurry, in a secondary slurrying device, to produce a bitumen-containing aqueous stream. The product emerging from this secondary slurrying device is essentially a mixture of water, dispersed sand, and bitumen, together with rocks, and other debris, as well as any lumps of undigested tar sand that pass through this second treatment. To prevent such oversized material from entering the separatory vessels downstream, the output from the secondary slurrying device is passed through a vibrating screen similar to that used for removing rejects from the slurry emerging from the initial tumbler. The material passing the screen is essentially water, dispersed sand, and bitumen, together with small-sized rocks, while the rejects from this second-stage screening consist principally of rocks and other debris substantially free of bitumen. Such washed rejects commonly have a bitumen content of 0.5% by weight or less, and are discarded. Hence, bitumen that would be lost in the tumbler rejects according to prior art technology is, by the use of the invention, retained in the process to be recovered in the bituminous froth collected in the subsequent separatory steps.

In a preferred embodiment, the tumbler slurry flood water is so divided that: one portion enters the secondary slurrying device; another portion acts as wash water to bathe the secondary screen; a third portion is added to the slurry product passing through the secondary screen; and the remainder is added in the usual location i.e. the slurry sump situated beneath the primary screen. In this embodiment, the secondary diluted screened slurry is combined with the primary diluted screened slurry and advanced to the separatory step.

The division of fresh process water among the various locations in the two conditioning circuits may be varied according to the ease of digestion of the tar sand feed, the proportion of oversized material in the tar sand feed, and the type of slurrying device used in the secondary conditioning circuit. Nor is it necessary that fresh process water should be added at all points. Aqueous streams taken from other parts of the extraction process may be used alone or combined with fresh process water for these locations. For instance, mixing a portion of middlings from the downstream separatory step with fresh water for use in the secondary slurrying device can lead, in the case of certain tar sand feeds, to reduced total water usage and improved bitumen recovery for the process overall. Similarly, the diluted screened slurry from the secondary conditioning circuit may be added to the primary conditioning circuit either alone or with fresh process water by being introduced to any or all of the water addition locations: the tumbler, the screen wash, or the slurry dilution location.

Broadly stated, the invention is an improvement in the process for treating tar sand containing bitumen which comprises: mixing tar sand with hot water in a rotating conditioning vessel to produce a first slurry containing rocks and lumps of tar sand; screening the first slurry to remove the reject portion mainly comprising said rocks and lumps, both associated with bitumen; mixing said reject portion with hot water in another rotating conditioning vessel to disperse associated bitumen and produce a second slurry associated with rocks and some remaining lumps of tar sand; and screening rocks and lumps from said second slurry and recovering the major part of the bitumen in the primary reject portion as part of the second slurry, which second slurry is amenable to further dilution with hot water and retention in a separation vessel to recover contained bitumen as froth.

DESCRIPTION OF THE PREFERRED EMBODIMENT

Figure 1:
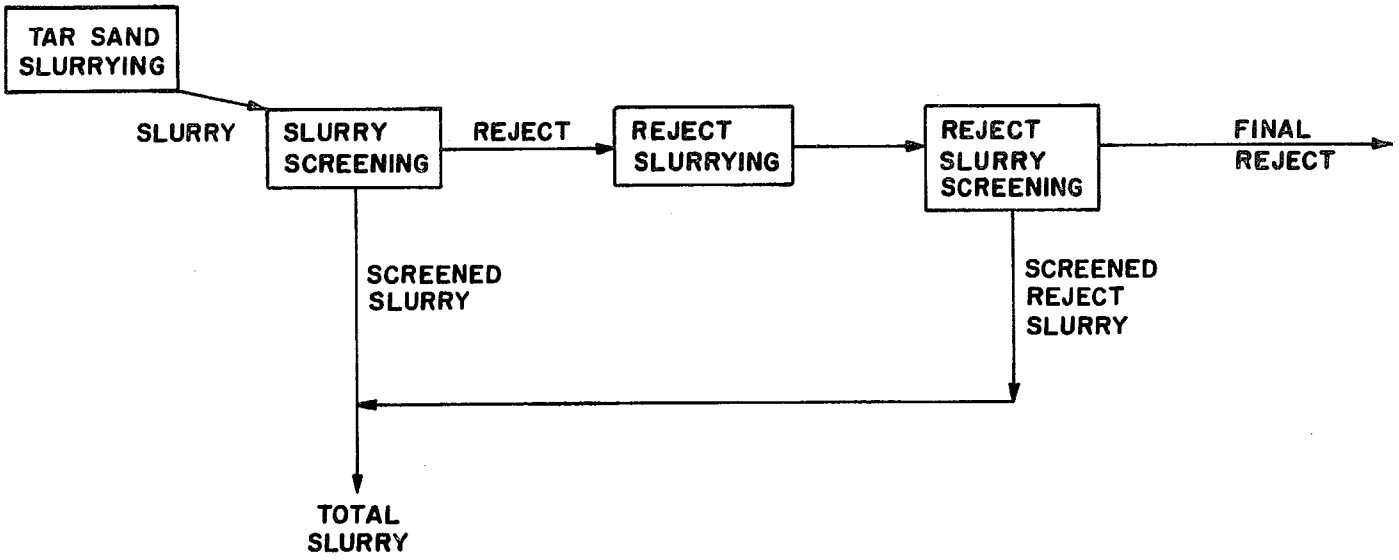
FIG. 1 is a block diagram setting forth the steps involved in a preferred form of the invention.
Figure 2:
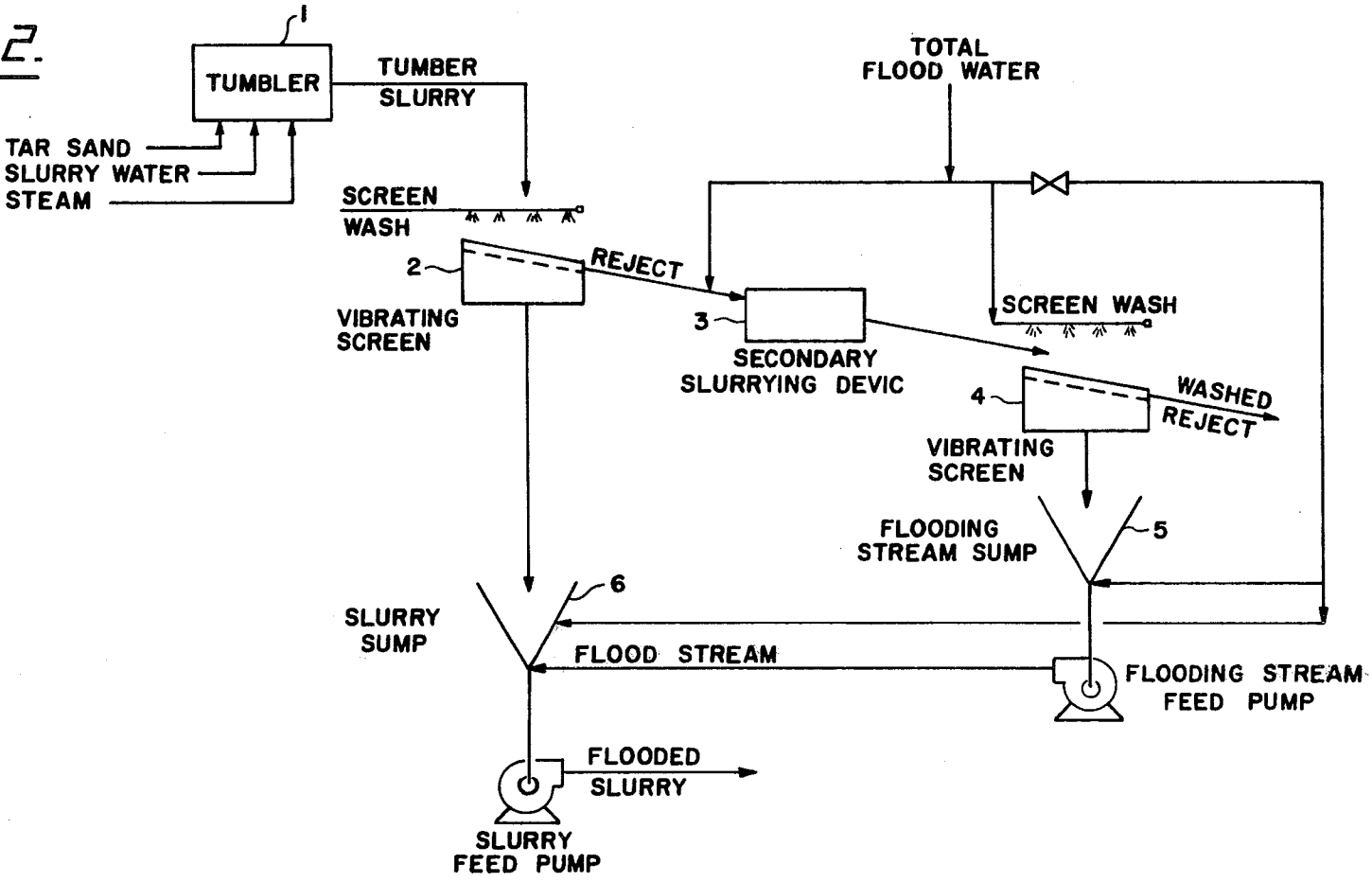
FIG. 2 is a schematic drawing illustrating the preferred embodiment of the invention of FIG. 1.

The invention is illustrated by the following example using a circuit as shown in the Figures.

Tar sand having an average composition of 11.59% by weight bitumen, 84.00% solids and 4.41% water is fed to a rotating tumbler 1, at a rate of 3250 pounds/hour. Hot slurry water, at a temperature of 190° F is added to the tumbler 1 at a rate of 610.3 pounds/hour. Steam, at a pressure of 50 psig is also fed to the tumbler 1 at a rate of 148.2 pounds/hour. The tumbler 1 produces a first slurry comprising 9.40% bitumen, 22.50% water and 68.10% solids which is washed through a ¼ inch mesh screen 2 with 235.4 pounds/hour of screen wash. The oversize rock and lump rejects from screen 2 amount to 188.3 pounds/hour and contain 2% bitumen by weight.

These rejects are fed to a tumbler or secondary slurrying device 3 and mixed with 25.0 pounds/hour of water at 190° F. This water constitutes a portion of the total flood water. Tumbler 3 produces a second slurry containing 1.76% bitumen, 20.54% water, and 77.70% solids which is washed through a ¼ inch mesh screen 4 with 20.0 pounds/hour of screen wash. Oversize reject from the screen 4 amounts to 20.0 pounds/hour and contains 0.5% bitumen by weight. Second slurry underflow from the screen 4 is collected in the flooding stream sump 5 and an additional portion of the total flood water, 100 pounds/hour, is added into this sump to produce a flooded second slurry containing 1.16% bitumen, 51.96% water, and 46.86% solids. This stream plus the remaining flood water, 935.3 pounds/hour, is fed to the slurry sump 6 which receives the first slurry underflow from the screen 2. The combination of these streams yields a flooded slurry containing 7.10% bitumen, 41.80% water and 51.10% solids and this slurry is then subjected to bitumen separation and recovery.

The embodiments of the invention in which exclusive property or privilege is claimed are defined as follows:

1. A process for producing a flooded slurry of tar sand containing bitumen which comprises:

mixing tar sand with hot water in a rotating conditioning vessel to produce a first slurry containing rocks and lumps of tar sand;

screening the first slurry to remove a reject portion mainly comprising said rocks and lumps, both associated with bitumen;

mixing said reject portion with hot water in another rotating conditioning vessel to disperse associated bitumen and produce a second slurry containing rocks and some remaining lumps of tar sand; and screening rocks and lumps from said second slurry and combining the screened second slurry with the screened first slurry to form a flooded slurry capable of being pumped to a separation vessel.

* * * * *